US006186307B1

(12) United States Patent
Mukai

(10) Patent No.: US 6,186,307 B1
(45) **Date of Patent: *Feb. 13, 2001**

(54) SHEETS HANDLING APPARATUS

(75) Inventor: Masanori Mukai, Kawasaki (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/860,952

(22) PCT Filed: Nov. 21, 1996

(86) PCT No.: PCT/JP96/03424

§ 371 Date: Jul. 14, 1997

§ 102(e) Date: Jul. 14, 1997

(87) PCT Pub. No.: WO97/19426

PCT Pub. Date: May 29, 1997

(30) Foreign Application Priority Data

Nov. 21, 1995 (JP) ..... 7-303198

(51) Int. Cl.[7] ..... G07D 7/04
(52) U.S. Cl. ..... 194/206
(58) Field of Search ..... 194/206, 207

(56) References Cited

U.S. PATENT DOCUMENTS

| | | | | |
|---|---|---|---|---|
| 3,731,799 | | 5/1973 | Meloni et al. . | |
| 4,365,700 | * | 12/1982 | Arimoto et al. | 194/206 |
| 4,733,765 | * | 3/1988 | Watanabe | 194/206 |
| 5,151,607 | | 9/1992 | Crane et al. . | |

FOREIGN PATENT DOCUMENTS

| | | | | |
|---|---|---|---|---|
| 413534 | * | 2/1991 | (EP) | 194/206 |
| 50-60090 | | 6/1975 | (JP) . | |
| 54-139600 | | 10/1979 | (JP) . | |
| 58-17877 | | 2/1983 | (JP) . | |
| 58-175091 | | 10/1983 | (JP) . | |
| 61-72387 | | 4/1986 | (JP) . | |
| 63-303494 | | 12/1988 | (JP) . | |
| 90/07165 | | 6/1990 | (WO) . | |

OTHER PUBLICATIONS

Japanese Utility Model Application Laid–Open No. sho 50–60090.
Japanese Patent Application Laid–Open No. sho 54–139600.
Korean Search Report for Korean Patent Application No. 97–704873 dated Nov. 29, 1999.

* cited by examiner

*Primary Examiner*—F. J. Bartuska
(74) *Attorney, Agent, or Firm*—Staas & Halsey, LLP

(57) ABSTRACT

A sheets handling apparatus efficiently handles inserted sheets. The sheets handling apparatus includes an inserting unit into which the sheets are inserted and a discriminating unit for discriminating among the sheets inserted into the inserting unit. The sheets handling apparatus further includes a mechanism for returning, to the inserting unit, the sheets (which have, e.g., no thread and are an inappropriate size exhibiting predetermined characteristics among the sheets inserted in the inserting unit without being supplied to the discriminating unit. According to this sheets handling apparatus, no time is consumed when the discriminating unit discriminates among the sheets to easily recognize inappropriateness thereof. Such sheets are not carried to the discriminating unit, and hence a probability of causing a jam decreases.

4 Claims, 7 Drawing Sheets

SHEETS HANDLING APPARATUS

TECHNICAL FIELD

The present invention relates to a sheets handling apparatus for discriminating sheets to determine whether they are genuine or false and handling them and, for example, to a sheets handling apparatus used for actualizing an ATM (Automatic Teller's machine).

BACKGROUND ARTS

In recent years, with advancements of automation in a variety of sectors, apparatuses automatically discriminate among paper money, securities, certificates of tax payments, book coupons, beer coupons, a variety of tickets and admission tickets (which are referred to as sheets).

Specific construction of such apparatuses (hereinafter termed sheets handling apparatus) differ depending on the type of sheets to be handled by the apparatuses. For instance, the sheets handling apparatus that treats paper money includes an inserting unit into which the sheets are put, a discriminating unit for making a discrimination as to whether or not the sheet put into the inserting unit is appropriate, a discharging unit for discharging the sheet discriminated as inappropriate by the discriminating unit, a storing unit for storing the sheets discriminated as appropriate by the discriminating unit of the sheets handling apparatus treating the paper money, and a carry mechanism for transferring the sheets between the respective units. Further, this sheets handling apparatus includes an operation unit through which the user indicates a content of the operation of the sheet handling apparatus, and a control unit for generally controlling the respective units.

The control unit, when operating the operational unit to indicate a receipt of the paper money, the paper money put into the inserting unit is carried sheet by sheet to the discriminating unit by controlling the inserting unit and the carry mechanism between the inserting unit and the discriminating unit.

The discriminating unit includes an optical sensor for obtaining whole image data in order to acquire information about an external shape, etc. of the paper money, a magnetic sensor for detecting an existence of magnetic ink, a thickness sensor for detecting a thickness of the paper money, and dictionary data comprising of the image data, etc. of the appropriate paper money. The discriminating unit makes the discrimination as to whether or not the paper money carried in is appropriate based on the information obtained by the various sensors as well as on the dictionary data. The control unit, if the paper money is discriminated as appropriate by the discriminating unit, stores the storing unit with the paper money by controlling the carry mechanism provided between the discriminating unit and the storing unit. On the other hand, the control unit, if the paper money is discriminated as inappropriate by the discriminating unit, carries this paper money to the discharging unit by controlling the carry mechanism provided between the discriminating unit and the discharging unit. That is to say, the sheets handling apparatus stores only the paper money discriminated as appropriate by the discriminating unit among the sheets of paper money put into the inserting unit by the user, and returns the paper money other than the above-mentioned money to the user via the discharging unit.

Thus, the conventional sheets handling apparatus is constructed so that the discriminating unit minutely discriminates among the paper money (sheets) put into the inserting unit. Therefore, if a different kind of paper money is mistakenly put thereinto, i.e., when the paper money easily visually discriminated as inappropriate is put thereinto, the inappropriate paper money is carried to the discriminating unit and, after obtaining a result of the discrimination by the discriminating unit, carried to the discharging unit.

Thus, the conventional sheets handling apparatus, as it happens, performs futile processes. Further, since it might happen that the inappropriate paper money is carried by the carry mechanism designed for the appropriate paper money, a probability of causing a jam is high in the conventional sheets handling apparatus.

DISCLOSURE OF THE INVENTION

Accordingly, it is an object of the present invention to provide a sheets handling apparatus for efficiently handling inserted sheets.

To accomplish the above object, according to the present invention, a sheets handling apparatus comprises a discriminating unit for making discriminations as to whether sheets are appropriate or not, a preparatory discriminating unit for making discriminations as to whether or not the sheets put in have predetermined characteristics, and a supplying unit for supplying the discriminating unit with only the sheets so discriminated by the preparatory discriminating unit as to have the predetermined characteristics.

In the thus constructed first sheets handling apparatus, if the sheet put into the handling apparatus is not appropriate, this sheet is discriminated. Hence, this sheets handling apparatus efficiently handles the inserted sheets. Further, obviously inappropriate sheets are not carried to the discriminating unit, and therefore the probability of causing a jam is low in the present sheets handling apparatus.

Moreover, a second sheets handling apparatus according to the present invention comprises a discriminating unit for making discriminations as to whether or not sheets are appropriate, a holding unit for holding a plurality of sheets to be discriminated, a fetching unit for sequentially fetching the plurality of sheets held by the holding unit, a preparatory discriminating unit for making discriminations as to whether or not the sheets fetched by the fetching unit have predetermined characteristics, and a supplying unit for supplying the discriminating unit with only the sheets so discriminated by the preparatory discriminating unit as to have the predetermined characteristics.

In the thus constructed second sheets handling apparatus, an obviously inappropriate sheet is discriminating from among the sheets put into the handling apparatus. Accordingly, the present sheets handling apparatus invariably efficiently handles the inserted paper money. Further, as the obviously inappropriate sheets are not carried to the discriminating unit, the probability of causing a jam is low in the second sheets handling apparatus.

Incidentally, on the occasion of actualizing the second sheets handling apparatus, it is desirable to use a supplying unit for supplying the discriminating unit with the sheets so discriminated by the preparatory discriminating unit as having the predetermined characteristics, and returning, to the holding unit, the sheets so discriminated by the preparatory discriminating unit as not having the predetermined characteristics.

Furthermore, on the occasion of actualizing the second sheets handling apparatus, a unit may be used as the preparatory discriminating unit for obtaining data about a shape of the sheet fetched by the fetching unit and, if the obtained data falls within a predetermined range, determining that the sheet has the predetermined characteristics. In the case of constructing the sheets handling apparatus in this way, the sheets having inappropriate shapes are not carried to the discriminating unit and, hence, the probability of causing the jam can be further reduced.

Further, a unit may be used as the preparatory discriminating unit for detecting whether or not a thread exists on the sheet fetched by the fetching unit, and making a discrimination as to whether or not the sheet has the predetermined characteristics on the basis of a result of the detection. Incidentally, in the case of constructing the sheets handling apparatus treating the sheets having the threads, the preparatory discriminating unit is used for making such a discrimination that the sheet has the predetermined characteristic when the thread exists on the sheet. Reversely, in the case of constructing the sheets handling apparatus treating the sheets having no thread, the preparatory discriminating unit is used for making such a discrimination that the sheet has the predetermined characteristic when the thread does not exist on the sheet.

DETAILED DESCRIPTION OF THE PREFERRED EMBODIMENTS

Embodiments of the present invention will hereinafter be specifically described with reference to the drawings.

First Embodiment

A sheets handling apparatus in a first embodiment functions as an ATM (automatic teller's machine) for treating paper money having a thread. Note that the thread is a tape composed of a metal or the like and provided for making it difficult to forge sheets by copying them.

Figure 1:
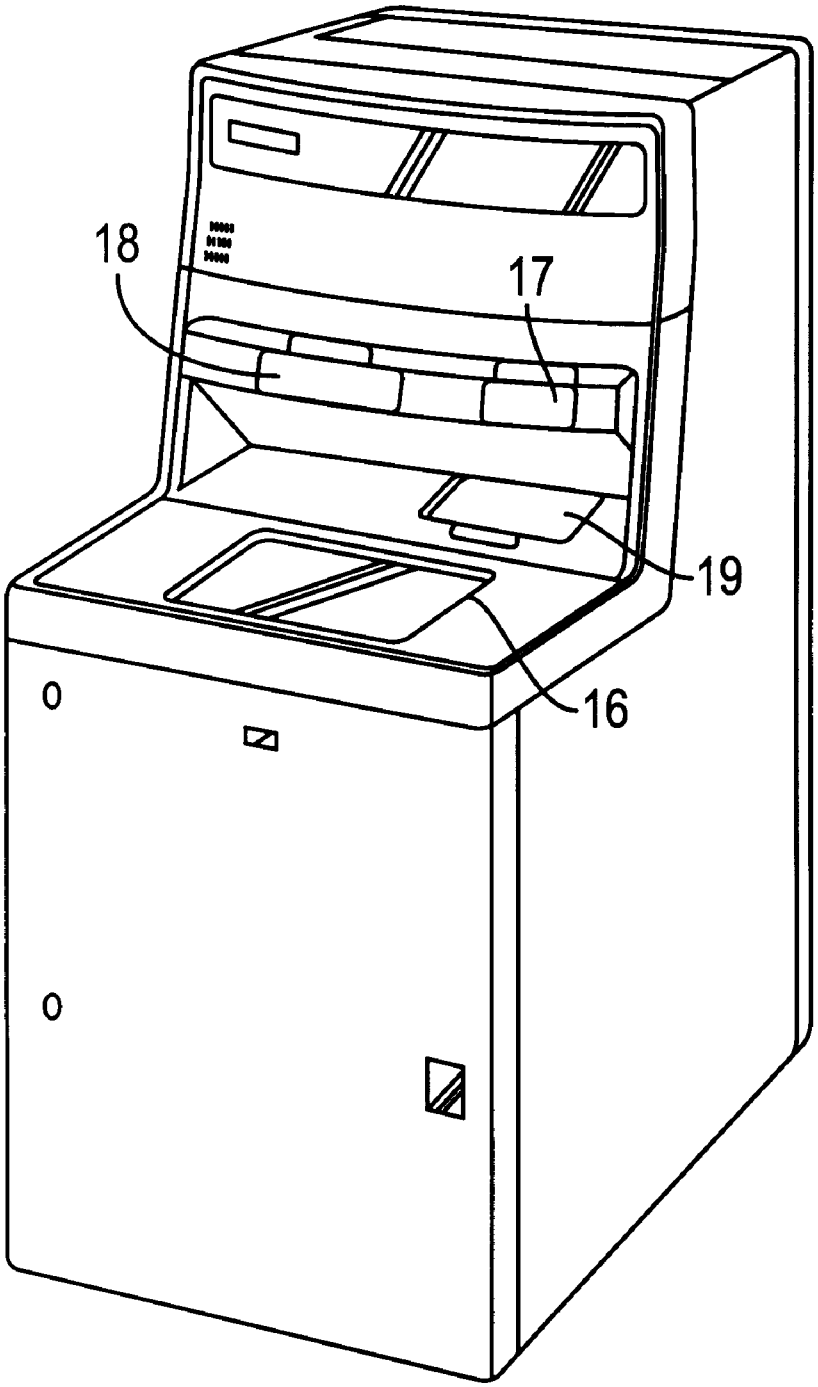
FIG. 1 is a view showing an external shape of a sheets handling apparatus in a first embodiment of the present invention.

FIG. 1 shows an outward appearance of a sheets handling apparatus in the first embodiment. As shown in FIG. 1, a box body of the sheets handling apparatus is provided with an operation unit 16, a card inserting/discharging port 17, a banknote inserting/discharging port 18, and a paper money inserting/discharging port 19.

The respective units function in the same way as a normal ATM. Namely, the operation unit 16 is comprised of a display device for displaying a message relative to operation procedures, and an input device for inputting various items of information (a password number, an amount of money, a bank account number, etc.). The display device displays a message (image data) corresponding to data given from a control unit (which will be explained in detail later) provided in the sheets handling apparatus. The input device outputs to the control unit the data corresponding to a content of the operation by the user.

A card recorded with bank account data is inserted into the card inserting/discharging port 17. Provided in rear of the card inserting/discharging port 17 are a device for reading magnetic information stored on the card, a device for reading information written on the surface of the card, and a carry mechanism for supplying the card to these devices. The control unit guides inward the card inserted into the card inserting/discharging port 17 and reads the information held on this card by controlling the carry mechanism and the devices. Then, the control unit, on the basis of the information read therefrom, exchanges the information with a center computer connected via a communications line and recognizes an executable process.

Incidentally, the card inserting/discharging port 17 is also used as a discharge port for slips recorded with information pertaining to a transaction dealt with. Therefore, a mechanism for executing slip processing is also provided posterior to the card inserting/discharging port 17, and the control unit controls this mechanism.

A banknote is inserted into the banknote inserting/discharging port 18. Provided in rear of the banknote inserting/discharging port 18 is a mechanism for printing a content of the transaction on the banknote inserted thereinto.

The paper money inserting/discharging port 19 functions as a port through which the paper money is inserted and discharged. A mechanism for actually treating the paper money is provided posterior to the paper money inserting/discharging port 19. As already explained, the conventional sheets handling apparatus includes the same mechanism by which the paper money inserted is each discriminated, however, the sheets handling apparatus in the first embodiment includes a mechanism operating differently therefrom by way of the mechanism actually treating the paper money.

The following is a detailed description of a construction and an operation of the mechanism provided for actually treating the paper money within the sheets handling apparatus in the first embodiment.

Figure 2:
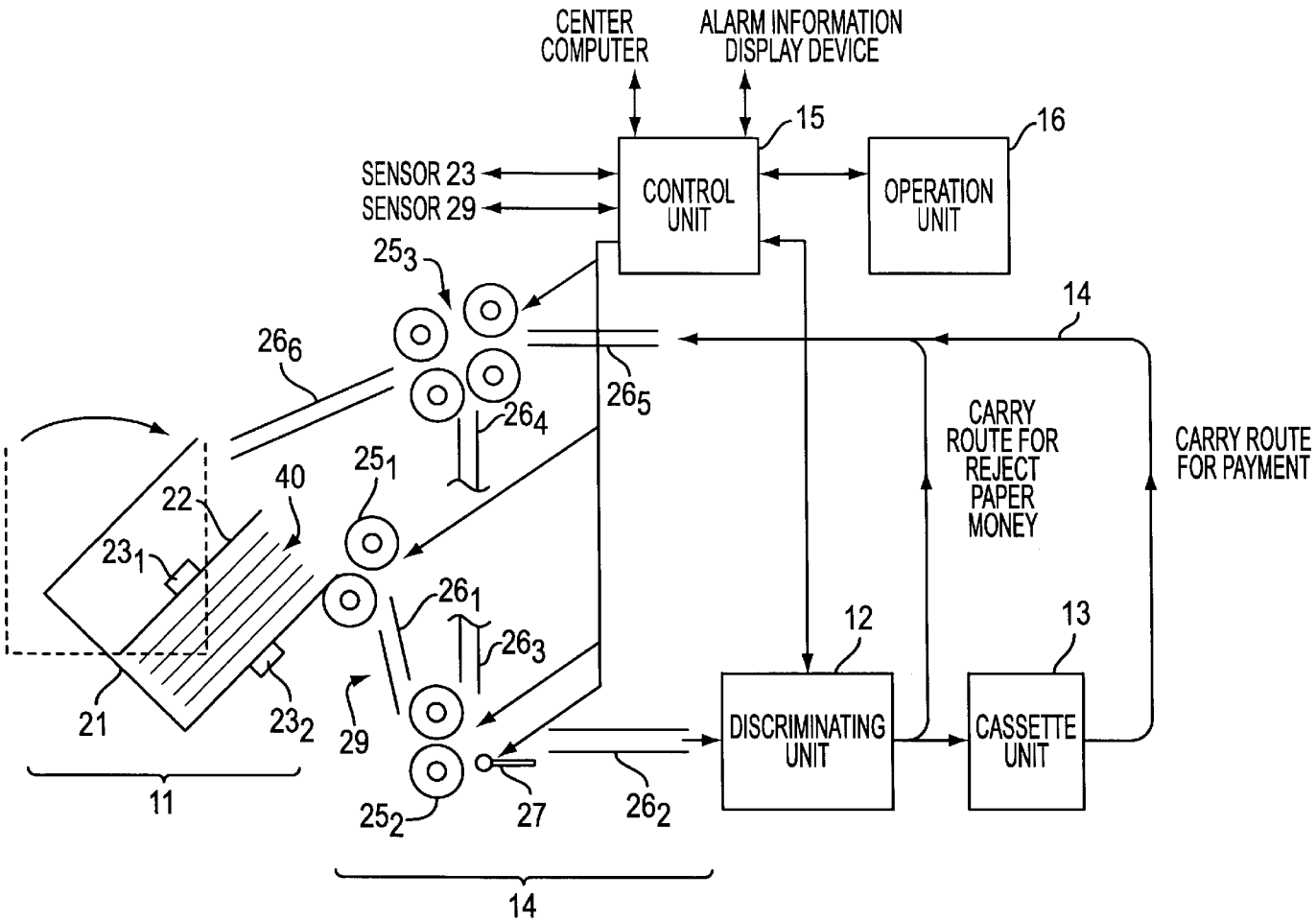
FIG. 2 is a view showing a construction of the sheet handling apparatus in the first embodiment.

FIG. 2 is a diagram schematically illustrating a construction of the sheets handling apparatus in the first embodiment. Note that the mechanisms relative to the card inserting/discharging port and the banknote inserting/discharging port operate in the same way with the corresponding mechanisms provided within the normal ATM, and hence the illustrations thereof are omitted in the drawings.

As shown in FIG. 2, the sheets handling apparatus in the first embodiment incorporates an inserting unit 11, a discriminating unit 12, a cassette unit 13, and a carry system 14 in charge of carrying the paper money therebetween. Further, the above-mentioned control unit 15 and operation unit 16 are provided within the sheets handling apparatus. Note that the control unit 15 comprises a central processing unit (CPU), a ROM (Read Only Memory), a RAM (Random Access Memory), a control circuit (a so-called driver) for controlling a variety of drive mechanisms provided within the sheets handling apparatus, and an information communications circuit. The control unit 15 is connected to the respective units via analog or digital signal lines (buses) within the handling apparatus. Further, as already explained, the control unit 15 is connected to the center computer that controls the information relative to the users via the communications lines. Moreover, the control unit 15 is also connected to an alarm information display device. Incidentally, the alarm information display device is a computer for controlling operation conditions of the sheets handling apparatus, and is normally installed in a place where a manager of the sheets handling apparatus stays.

The inserting unit 11 is used when transferring and receiving the paper money between the user and the sheets handling apparatus, and corresponds to the paper money inserting/discharging port 19 (FIG. 1). The inserting unit 11 includes a paper money container 21 having an opening, and a partition 22 for partitioning a space within the paper money container 21 into two spaces. One space (hereinafter referred to as a first space) partitioned by the partition 22 is used for temporarily holding the paper money that should be stored in the sheet handling apparatus, while the other space (hereinafter termed a second space) is used for holding the paper money that should be received by the user. Further, the inserting unit 11 also includes a drive mechanism (unillustrated) for changing a position of the partition 22 within the paper money container 21. This drive mechanism is connected via a control signal line to the control unit 15, and the control unit 15 moves the partition 22 to a position corresponding to a condition thereat by controlling the drive mechanism, using the control signal line (which will be described in greater detail).

Further, the inserting unit 11 includes a sensor 23 for detecting whether or not the paper money is held in the first space. The sensor 23 consists of a light emitting element $\mathbf{23}_1$ fixed to the partition 22 so that the first space can be irradiated with a light beam, and a light receiving element $\mathbf{23}_2$ fixed in a position upon which the light beam from the light emitting element $\mathbf{23}_1$ is incident. The light emitting element $\mathbf{23}_1$ and the light receiving element $\mathbf{23}_2$ are respectively connected to the control unit 15 via the signal lines, and the control unit 15 judges whether or not the paper money is held in the inserting unit 11 (in the first space of the paper money holding container 21) by use of those signal lines. That is to say, the control unit 15 controls the light emitting element $\mathbf{23}_1$ to output a light beam with a predetermined level, and detects a level of a signal outputted from the light receiving element $\mathbf{23}_2$ corresponding thereto. Then, if the detected level is under the level which is predetermined on the basis of the signal level when no paper money exists, it is determined that the paper money exists in the inserting unit 11.

Figure 3:
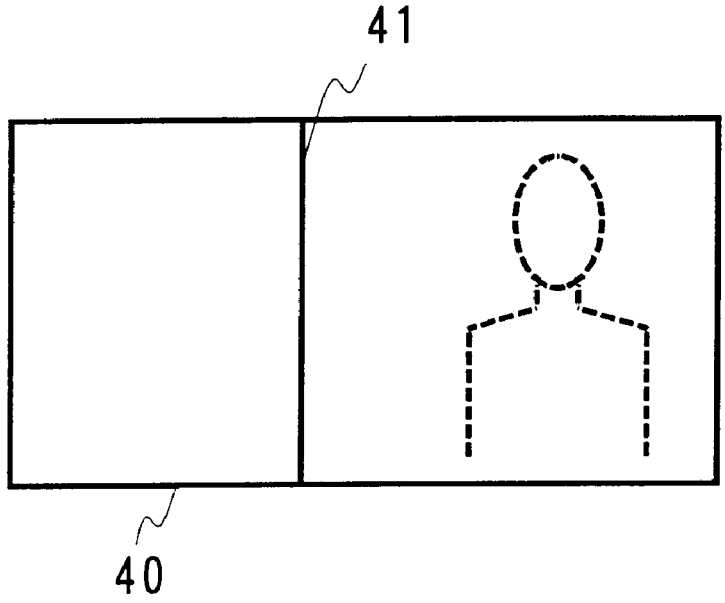
FIG. 3 is a schematic view illustrating paper money treated by the sheets handling apparatus in the first embodiment.

The inserting unit 11 having such a construction is fixed through a rotary mechanism controlled by the control unit 15 to the box body of the sheets handling apparatus in the first embodiment so as to take an attitude indicated by a dotted line and an attitude indicated by a solid line in FIG.2. Note that the attitude indicated by the dotted line is such an attitude that the opening of the paper money container 21 is directed toward an opening/closing cover provided on the box body, and, if operated to indicate the operation unit 16 to receive the money, the control unit 15 makes the paper money container 21 takes this attitude. Further, the control unit 15 changes the position of the partition 22 so that the paper money is inserted into only the first space, and uncloses the opening/closing cover. Incidentally, as already stated, the present sheets handling apparatus treats the paper money having the thread and is, specifically, constructed as a handling apparatus which treats, as schematically illustrated in FIG. 3, the paper money provided with a thread 41 extending in a direction parallel to the short side of paper money 40. Further, the paper money 40 is inserted into the inserting unit 11 in such a form as to be indicated by an arrow head. That is, the paper money 40 is held in the first space of the inserting unit 11 so that a longitudinal direction thereof is parallel to a depthwise direction of the paper money container 21.

After being operated to direct the operation unit 16 to receive the money, and when detecting that predetermined operations (receipt of money, and input of information) have been done, the control unit 15 closes the opening/closing cover. Subsequently, the control unit 15 moves the partition 22 toward a wall surface, on the side of the first space, of the paper money container 21 and tilts the paper money container 21 to facilitate a feed-out of the paper money from the paper money container 21. Then, the control unit 15 starts controlling the carry system 14.

Before explaining a construction and a function of the carry system 14, an outline of the discriminating unit 12 and the cassette unit 13 will be described. At first, a construction and an operation of the discriminating unit 12 are explained with reference to FIG. 4.

Figure 4:
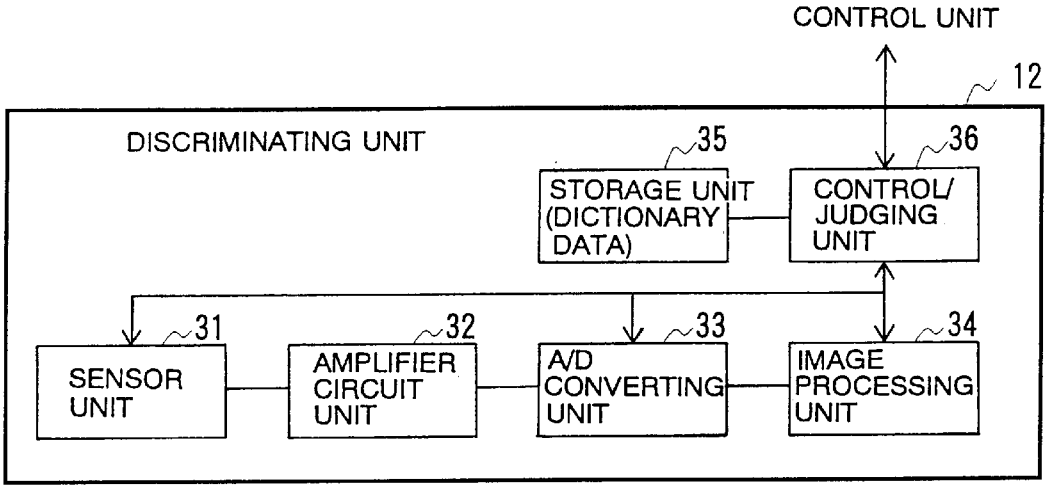
FIG. 4 is a block diagram showing a discriminating unit provided in the sheets handling apparatus in the first embodiment.

As shown in FIG. 4, the discriminating unit 12 has a sensor unit 31, an amplifier circuit unit 32, an A/D converting unit 33, an image processing unit 34, a storage unit 35, and a control/judging unit 36.

The sensor unit 31 is constructed of a few sensors for obtaining various items of data (image data, magnetic data and thickness data) relative to the paper money. The amplifier circuit unit 32 amplifies the analog signals outputted by the respective sensors within the sensor unit 31. The A/D converting unit 33 converts the analog signals from the amplifier circuit unit 32 into digital signals, and supplies the thus converted digital signals to the control/judging unit 36 or the image processing unit 34. Note that the A/D converting unit 33 is controlled by the control/judging unit 36 so as to supply the image processing unit 34 with the image data and supply the control/judging unit 36 with other data. Further, the control/judging unit 36 controls the respective sensors within the sensor unit 31 and an operation timing of the A/D converting unit 33.

The image processing unit 34 image-processes the image data supplied from the A/D converting unit 33. The control/judging unit 36 compares the image data outputted by the image processing unit 34 with the image data stored as dictionary data in the storage unit 35. Further, the control/judging unit 36 compares other items of data (magnetic data, and thickness data) given from the A/D converting unit 33 with corresponding data stored as dictionary data in the storage unit 35, and discriminating between appropriate or inappropriate as to the paper money from a result of the comparison. Then, the control/judging unit 36 notifies the control unit of a result of the discrimination.

The discriminating unit 12 operating in this way is connected via the carry system 14 to the inserting unit 11 of the sheets handling apparatus in the first embodiment.

The cassette unit 13 is constructed of a plurality of cassettes for storing the sheets of paper money according to classifications of the money. The cassette unit 13 is connected via the carry system 14 to the discriminating unit 12 and is stored with the paper money discriminated as appropriate by the discriminating unit 12.

Next, a construction of the carry system 14 is explained.

The carry system 14 is a carry route for the paper money between the inserting unit 11, the discriminating unit 12 and the cassette unit 13, and is constructed of such elements as a roller unit 25, a carry path 26 and a route switching unit 27. Note that there are omitted illustrations of elements relative to the carry route for returning the paper money (reject paper money) discriminated as inappropriate by the discriminating unit 12 to the inserting unit 11, and to the carry route extending from the cassette unit 13 to the inserting unit 11 which route is used when paying the money in FIG. 2. Further, several roller units, though provided between a carry path $\mathbf{26}_3$ and a carry path $\mathbf{26}_6$, are also omitted in their illustrations.

Each roller unit 25 consists of some (normally two) rollers and a roller drive mechanism for rotating these rollers. Each roller unit 25 (roller drive mechanism) is electrically connected to the control unit 15 and controlled by the control unit 15. Provided between the two roller units 25 is the carry path 26 serving as a element for guiding the paper money fed out by one roller unit 25 to the other roller unit 25.

The roller unit $\mathbf{25}_1$ is driven when feeding the paper money 40 out of the inserting unit 11 (paper money container 21). The roller unit $\mathbf{25}_2$ is driven for supplying the next roller unit 25 with the paper money fed out by the roller unit $\mathbf{25}_1$. As shown in FIG. 2, the carry path $\mathbf{26}_2$ for carrying the paper money toward the discriminating unit 12 and the carry path $\mathbf{26}_3$ for transferring the paper money toward the roller unit $\mathbf{25}_3$, are provided on the discharging side of the roller unit $\mathbf{25}_2$. Provided further between the roller unit $\mathbf{25}^2$ and the carry paths $\mathbf{26}_2$, $\mathbf{26}_3$ is the route switching unit 27 for guiding the paper money fed out of the roller unit $\mathbf{25}_2$ to one of the carry paths $\mathbf{26}_2$, $\mathbf{26}_3$. Note that the route switching unit 27 is constructed of a flap and an actuator electrically connected to the control unit 15.

Moreover, the carry path $\mathbf{26}_1$ provided between the roller unit $\mathbf{25}_1$ and the roller unit $\mathbf{25}_2$ includes a sensor 29. The sensor 29 is an element for detecting whether the paper money has the thread or not, and an output of the sensor 29 is inputted to the control unit 15. Incidentally, in the sheets handling apparatus in the first embodiment, a magnet resistance element is used as the sensor 29.

The roller unit $\mathbf{25}_3$ has four rollers. The roller unit $\mathbf{25}_3$ is used for supplying the paper money supplied via the carry path $\mathbf{26}_5$ toward a direction of the carry path $\mathbf{26}_6$ as well as for supplying the paper money supplied from the roller unit $\mathbf{25}_2$ via the carry path $\mathbf{26}_4$ in the direction of the carry path $\mathbf{26}_6$.

Figure 5:
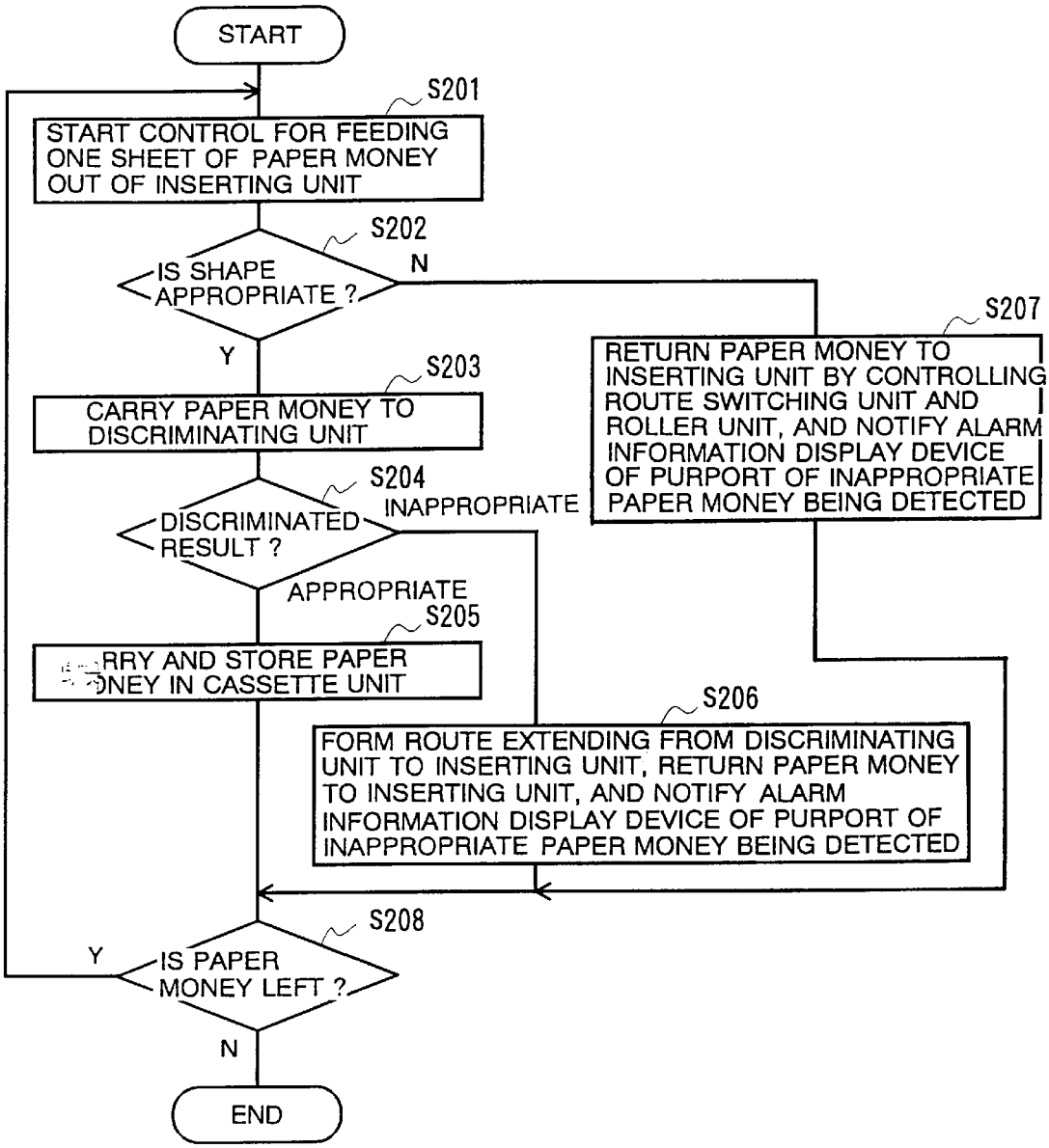
FIG. 5 is an explanatory flowchart showing operations of the sheets handling apparatus in the first embodiment.
Figure 6B:
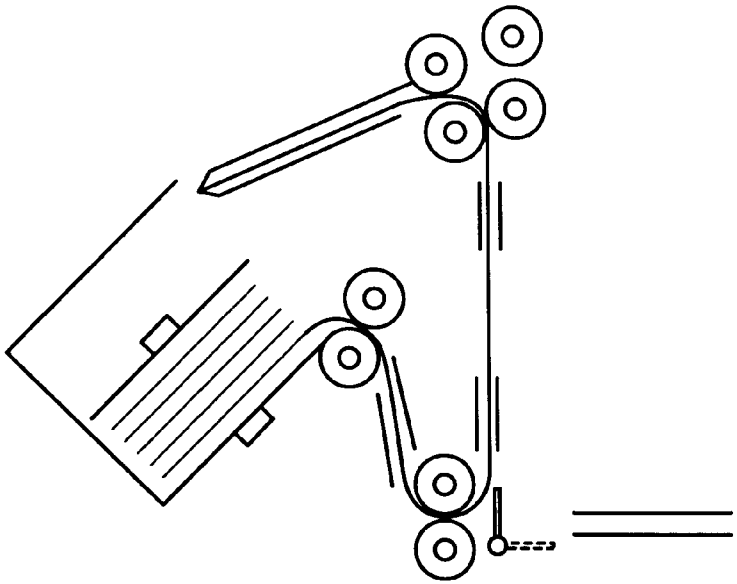
FIGS. 6(*a*) and (*b*) are schematic views showing carry routes for the paper money in the sheets handling apparatus in the first embodiment when the paper money discriminated as appropriate and inappropriate in preparatory discriminations, are inserted.
Figure 6A:
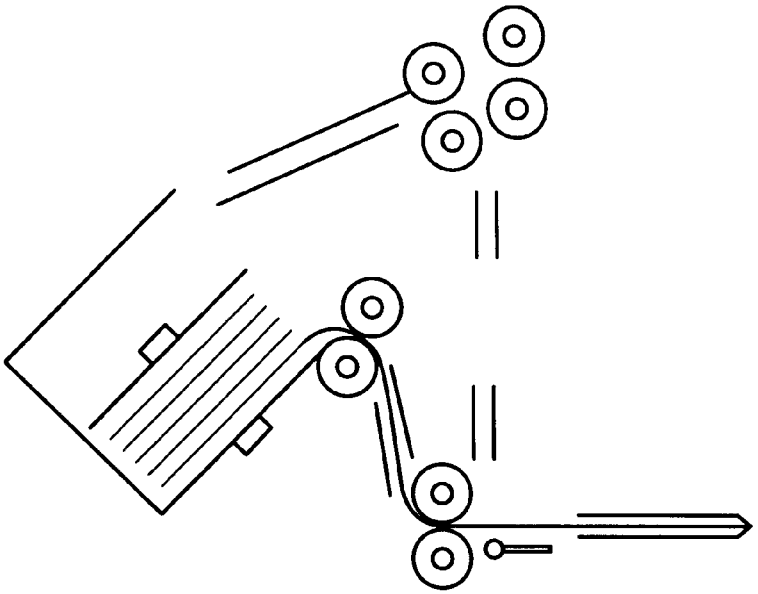

Hereinafter, a general operation (control procedures by the control unit 15) of the present sheets handling apparatus will be described with reference to FIGS. 2, 5 and 6. Note that FIG. 5 is a flowchart showing the control procedures by the control unit 15 when the paper money container 21 (inserting unit 11) takes the attitude shown in FIG. 2. Namely, the control unit 15 detects that the paper money has been completely set in the inserting unit 11, and starts the control along the flow shown in the flowchart after tilting the paper money container 21. Further, FIG. 6 is a schematic view showing the carry path for the paper money within the sheets handling apparatus in the first embodiment.

After tilting the inserting unit 11 enough to feed out the paper money, the control unit 15 starts controlling the roller unit $\mathbf{25}_1$ to feed only one sheet of paper money out of the inserting unit 11 (step S101). Further, simultaneously with the start of this control, the control unit 15 launches monitoring the signals from the sensor 29. Then, when the sensor 29 outputs a signal higher than the predetermined level within a predetermined time, i.e., when the thread exists on the paper money passing through the carry path $\mathbf{26}_1$ (step S102; Y), the control unit 15 controls the route switching unit 27 so that the paper money from the roller unit $\mathbf{25}_2$ is guided to the carry path $\mathbf{26}_2$, and controls the respective roller units 25 constituting the carry route extending to the discriminating unit 12, thereby carrying the paper money to the discriminating unit 12 (step S103). That is to say, the control unit 15 controls the respective units so that the paper money is carried on the route indicated by the arrowhead in FIG. 6(*a*).

Then, the control unit 15 makes the discriminating unit 12 discriminate this paper money and, if the discriminating unit 12 notifies it of a result of the discrimination showing the appropriateness of the paper money (step S104; appropriate), controls the roller unit relative to the carry route extending from the discriminating unit 12 to the cassette unit 13, thereby carrying this paper money to the cassette unit 13 and storing it (step S105). Thereafter, whether or not non-discriminated paper money is left in the inserting unit 11 is judged by controlling the sensor 23 provided in the inserting unit 11. If left (step S108; Y), the processing returns to step S101, and a process concerning the next paper money is started.

Further, if the result of the discrimination by the discriminating unit 14 shows the inappropriateness of the paper money (step S104; inappropriate), the control unit 15 forms a carry route extending from the discriminating unit 12 to the inserting unit 11 by controlling the unillustrated route switching unit. Then, the paper money discriminated as inappropriate (reject paper money) by the discriminating unit 12 is sent back to the inserting unit 11 (the second space if the paper money container 21) by controlling the roller unit relative to the same carry route (step S106). Further, the control unit 15 notifies the alarm information display device of the inappropriate paper money being detected (step S108), and proceeds to step S108. Incidentally, the control unit 15 also notifies the alarm information display device of the fact that the paper money is judged to be inappropriate in the discrimination by the discriminating unit 12 in step S108. Subsequently, the alarm information display device receiving this notification displays a message indicating that the paper money judged to be inappropriate by the discriminating unit 12 is put into the sheets handling apparatus.

On the other hand, when detecting that no thread exists on the paper money during passage through the carry path $\mathbf{26}_1$ on the basis of the signal from the sensor 29 (step S102; N), the control unit 15 controls the route switching unit 27 so that the paper money fed out of the roller unit $\mathbf{25}_2$ advances toward not the discriminating unit 12 but the roller unit $\mathbf{25}_3$. Then, the control unit 15 controls the roller unit $\mathbf{25}_3$ or the like, thereby returning this paper money into the inserting unit 11 (the second space of the paper money container 21) via the carry paths $\mathbf{26}_4$ $\mathbf{26}_6$. Further, along with such control, the control unit 15 notifies the alarm information display device of the paper money being judged to be inappropriate not in the discrimination by the discriminating unit 12 but in a preparatory discrimination by the sensor 29 (step S107). Then, the alarm information display device receiving this notification displays a message indicating that the paper money judged to be inappropriate in the preparatory discrimination is put into the sheets handling apparatus.

Subsequently, the control unit 15, if the non-discriminated paper money remains in the inserting unit 11 (step S108; Y), returns to step S101 and starts a process relative to the next paper money. Then, when finishing the discriminations of all the paper money put into the inserting unit 11 (step S108; N), the processes shown in the Figure are ended. Then, the control unit 15 executes processes such as printing the slip and exchanging the information with the center computer. Moreover, if in the execution of steps S106 and S107, the inserting unit 11, etc. is controlled so that the user is able to take out the paper money held in the inserting unit (the second space of the paper money container 21). Further, on this occasion, the control unit 15 also controls the operation unit 16 to display the messages corresponding to a series of discriminated results about the paper money (which include the result of the preparatory discrimination).

Thus, the sheets handling apparatus in the first embodiment is constructed in such a way that the paper money which can be discriminated as inappropriate without being discriminated by the discriminating unit among the sheets of paper money put into the inserting unit, are sent back to the inserting unit without being supplied to the discriminating unit. That is to say, in this sheets handling apparatus, the discrimination about the paper money conceived obviously inappropriate is not much of a time-consuming operation. Further, the sheets clearly conceived as inappropriate are not carried to the discriminating unit, and hence a probability of causing a jam in the carry system is decreased.

In addition, the message corresponding to the discriminated result is displayed on the operation unit 16, and therefore the user is able to easily recognize the reason why the paper money is returned. Moreover, the alarm information display device is also informed of the discriminated result, and hence the manager is capable of taking an immediate measure corresponding to the content thereof.

Second Embodiment

A sheets handling apparatus in a second embodiment is a modified version of the sheets handling apparatus in the first embodiment, and therefore only different constructions and operations are herein explained.

The sheets handling apparatus in the fist embodiment is a handling apparatus for making the preparatory discrimination among the sheets of paper money by detecting whether the thread exists thereon or not. Contrastingly, the sheets handling apparatus in the second embodiment is constructed to make the preparatory discrimination by detecting a shape of the paper money.

More specifically, in the sheets handling apparatus in the second embodiment, two optical sensors for detecting a width of the paper money are provided in the portion provided with the sensor 29 consisting of the magnetic resistance element in the sheets handling apparatus (see FIG. 2) in the first embodiment. The two optical sensors are disposed on the carry path $\mathbf{26}_1$ so that an interval therebetween in a direction orthogonal to the advancing direction of the paper money is set to a minimum value of the paper money treated by the sheets handling apparatus.

Further, a thickness sensor for measuring a thickness of the paper money is provided on the carry path $\mathbf{26}_1$ in the sheets handling apparatus in the second embodiment. The thickness sensor is constructed of two rollers combined so that an interval between the rollers changes corresponding to the thickness of the paper money passing between the rollers, and of a sensor, fitted to a rotary shaft of one roller, for outputting a signal of a level corresponding to the interval with the other roller.

Figure 7:
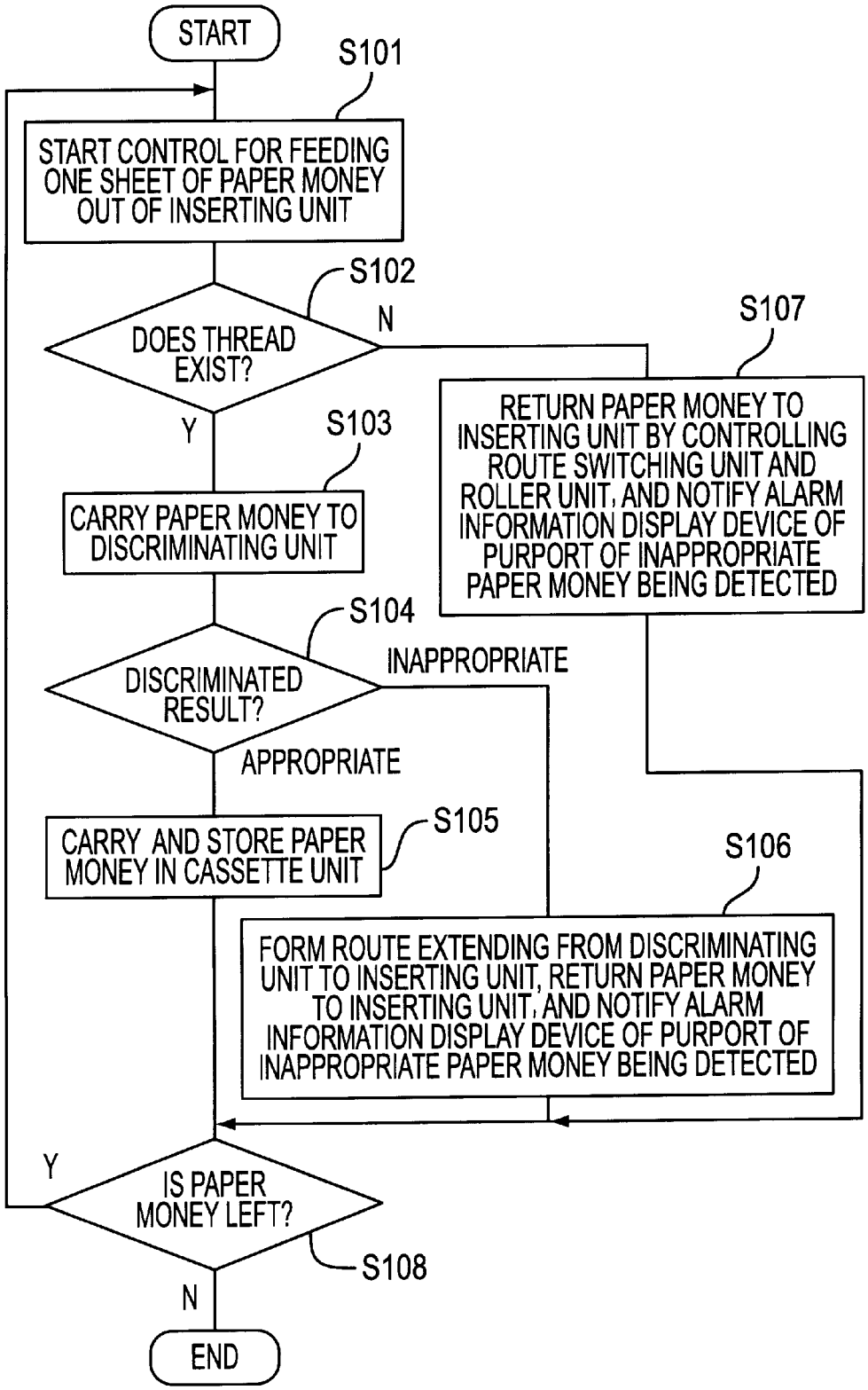
FIG. 7 is an explanatory flowchart showing operations of the sheets handling apparatus in a second embodiment.

Then, the control unit 15 in the sheets handling apparatus in the second embodiment, as shown in FIG. 7, judges whether the shape of the paper money is appropriate or not on the basis of the signals from those sensors, and determines whether the paper money should be supplied to the discriminating unit 12 or returned to the inserting unit 11 on the basis of a result of the above judgement. Note that the operations of the control unit 15 in respective steps excluding step S202 are the same as those of the control unit 15 in the sheets handling apparatus in the first embodiment. Therefore, only the operation in step S202 is herein described.

In step S202, the control unit 15 measures levels of the signals from the two optical sensors. Then, when detecting that the two optical sensors output the signals assuming the level indicating the existence of the paper money, a judgement is that the paper money has an appropriate width. In cases other than this, a judgement is that the paper money does not have an appropriate width. Further, the control unit 15 also measures a time for which the two sensors output the signal of the level indicating the existence of the paper money. Then, if the measured time is under a preset fiducial time, the control unit 15 judges that the paper money as a target for the preparatory discrimination has an inappropriate length. Moreover, the control unit 15 detects a thickness of the paper money that is on the passage through the carry path $\mathbf{26}_1$ on the basis of the signal from the thickness sensor. Then, the control unit 15, if the detected thickness does not fall within a predetermined range, judges that the preparatory discrimination target paper money has an inappropriate thickness.

Then, if all appropriate in terms of the width, the length and the thickness, the control unit 15 diverges to a "Y" side in order to carry the paper money to the discriminating unit 12 (step S203). Whereas, if inappropriate in one of the width, the length and the thickness, the control unit 15 diverges to a "N" side in order to return the paper money to the inserting unit 11 without supplying it to the discriminating unit 12 (step S207).

As discussed so far, the sheets handling apparatus in the second embodiment is constructed so that the paper money having the inappropriate shape amongst the sheets of paper money put into the inserting unit is sent back to the inserting unit without being supplied to the discriminating unit. That is to say, in this sheets handling apparatus, the discrimination among the sheets of paper money conceived obviously inappropriate is not a time-consuming operation. In addition, the sheets, which are small enough in size and thickness to cause a jam, are not sent to the discriminating unit, and hence the probability of causing the jam in the carry system decreases.

Modified Embodiment

The sheets handling apparatus in the first and second embodiments can be modified in a variety of forms. For example, the sheets handling apparatus in the first embodiment is modified so that the processing diverges to step S107 if the thread exists in step S102 and diverges to step S103 if not. If modified in this way, it is feasible to obtain the sheets handling apparatus that eliminates the paper money having the thread by the preparatory discrimination. Furthermore, the sheets handling apparatus in the first and second embodiments, though the inserting unit functioning as the inserting/discharging port for the paper money, may be separately provided with a mechanism functioning as a discharging port. Moreover, the sheets handling apparatus in the second embodiment detects the width, the length and the thickness of the paper money, but can be constructed to detect one or two items of data thereabout. Additionally, the sheets handling apparatus may be constructed so that the preparatory discrimination is performed based on other items of data (e.g., colors).

What is claimed is:

1. A sheets handling apparatus comprising:

discriminating means for making discriminations as to whether sheets are appropriate and for sending out the sheets discriminated as appropriate toward a first carry route;

holding means for holding a plurality of sheets to be discriminated;

fetching means for sequentially fetching the plurality of sheets held by said holding means;

preparatory discriminating means for making a discrimination as to whether the sheets fetched by said fetching means have predetermined characteristics, wherein the predetermined characteristics include a thread contained in the sheets; and supplying means for supplying said discriminating means with only the sheets so discriminated by said preparatory discriminating means as to have the predetermined characteristics and for returning the sheets so discriminated by said preparatory discriminating means as to have no predetermined characteristics to said holding means via a second carry route that contacts with an end of the first carry route, and having route switching means for contacting the second carry route with the end of the first carry route.

2. A method of handling sheets, comprising:

discriminating whether sheets have predetermined characteristics, wherein the predetermined characteristics include a thread contained in the sheets;

determining whether the sheets discriminated as having the predetermined characteristics are appropriate; and sending the sheets determined to be appropriate toward a first carry route and supplying the sheets discriminated as not having the predetermined characteristics via a second carry route which contacts with an end of the first carry route, and contacting the second carry route with the end of the first carry route, wherein the second carry route bypasses the step of determining whether the sheets are appropriate.

3. A sheets handling apparatus, comprising:

a first discriminating unit discriminating whether sheets have predetermined characteristics, wherein the predetermined characteristics include a thread contained in the sheets;

a second discriminating unit discriminating whether the sheets having the predetermined characteristics are appropriate and sending out the sheets discriminated as appropriate toward a first carry route; and a supplying unit supplying the sheets discriminated as not having the predetermined characteristics via a second carry route which contacts with an end of the first carry route, wherein the second carry route bypasses said second discriminating unit.

4. The apparatus as claimed in claim 3, wherein the predetermined characteristics are one of a predetermined width, a predetermined length and a predetermined thickness.

* * * * *